US006871030B2

(12) United States Patent
Nishimura

(10) Patent No.: US 6,871,030 B2
(45) Date of Patent: Mar. 22, 2005

(54) IMAGE FORMING APPARATUS

(75) Inventor: Soichiro Nishimura, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/377,807

(22) Filed: Mar. 4, 2003

(65) Prior Publication Data

US 2003/0175042 A1 Sep. 18, 2003

(30) Foreign Application Priority Data

Mar. 15, 2002 (JP) ..... 2002-071222

(51) Int. Cl.[7] ..... G03G 21/00; G03G 15/08

(52) U.S. Cl. ..... 399/98; 399/45; 399/349; 399/350; 399/353; 399/354

(58) Field of Search ..... 15/256.52; 399/45, 399/98, 107, 111, 149, 150, 343, 349, 350, 354

(56) References Cited

U.S. PATENT DOCUMENTS

| | | | | |
|---|---|---|---|---|
| 5,600,405 | A | 2/1997 | Umeda et al. | |
| 6,219,505 | B1 | 4/2001 | Sato et al. | |
| 6,304,735 | B1 * | 10/2001 | Nishimura et al. | 399/98 |
| 6,549,747 | B2 * | 4/2003 | Brown et al. | 399/353 |

FOREIGN PATENT DOCUMENTS

| | | |
|---|---|---|
| JP | 05-281881 | * 10/1993 |
| JP | A-07-06444 | 3/1995 |
| JP | A-09-269710 | 10/1997 |
| JP | A 2000-81819 | 3/2000 |
| JP | A 2001-13840 | 1/2001 |
| JP | A-2001-092322 | 4/2001 |

* cited by examiner

*Primary Examiner*—Hoang Ngo
(74) *Attorney, Agent, or Firm*—Oliff & Berridge, PLC

(57) ABSTRACT

The invention is directed to a paper dust removing device used in an image forming apparatus. The image forming apparatus has a latent image member that receives the latent image produced by a charge differential on the surface of the latent image device. A developing agent, or toner, is then applied to the latent image creating a visible image. The toner image is transferred to a paper as it passes between the latent image member and a transferring roller or device and subsequently processed to adhere the toner image to the paper. The apparatus further has a paper dust removing device that removes paper dust from the latent image member. A biasing device applies an electrical bias to the paper dust removing device to produce a potential difference between the latent image member and the paper dust removing device. As the total amount of formed images increases, it is necessary to control the biasing device to vary the bias applied to the paper dust removing device to preclude adhering toner, that remains on the latent image device, to the paper dust removing device.

27 Claims, 10 Drawing Sheets

IMAGE FORMING APPARATUS

BACKGROUND OF THE INVENTION

1. Field of Invention

The invention relates to an electrophotographic image forming apparatus.

2. Description of Related Art

U.S. Pat. No. 6,219,505 discloses an image forming apparatus having a paper dust removing brush for removing paper dust adhered on a surface of a photosensitive drum. The paper dust removing brush is provided close to a charging device so as to slide on the surface of the photosensitive drum.

The paper dust removing brush not only physically collects paper dust by tangling it with bristles but also electrostatically attracts paper dust on the surface of the photosensitive drum by application of a specified bias.

On the other hand, toner, which was not transferred to a sheet and remains on the photosensitive drum, may adhere to the paper dust removing brush. If the paper dust removing brush contains toner, the ability of the brush to remove paper dust may be reduced, or the surface of the photosensitive drum may be scratched by the toner adhered to the brush, causing a deterioration in print quality.

SUMMARY OF THE INVENTION

The invention is directed to a paper dust removing device used in an image forming apparatus. The image forming apparatus has a latent image member that receives the latent image produced by a charge differential on the surface of the latent image device. A developing agent, or toner, is then applied to the latent image creating a visible image. The toner image is transferred to a paper as it passes between the latent image member and a transferring roller or device as subsequently processed to adhere the toner image to the paper. The apparatus further has a paper dust removing device that removes paper dust from the latent image member. A biasing device applies a bias, an electrical bias, to the paper dust removing device to produce a potential difference between the latent image member and the paper dust removing device. As the total amount of formed images increases, it is necessary to control the biasing device to vary the bias applied to the paper dust removing device to preclude adhering toner, that remains on the latent image device, to the paper dust removing device.

The paper dust removing device is a brush comprising a large number of fine filaments. Preferably, the filaments have a high density of carbon associated therewith. In most cases, the electrical bias applied is decreased based upon the increased numbers of images formed.

BRIEF DESCRIPTION OF THE DRAWINGS

The invention will be described with reference to the drawings, in which.

DETAILED DESCRIPTION OF PREFERRED EMBODIMENTS

Figure 1:
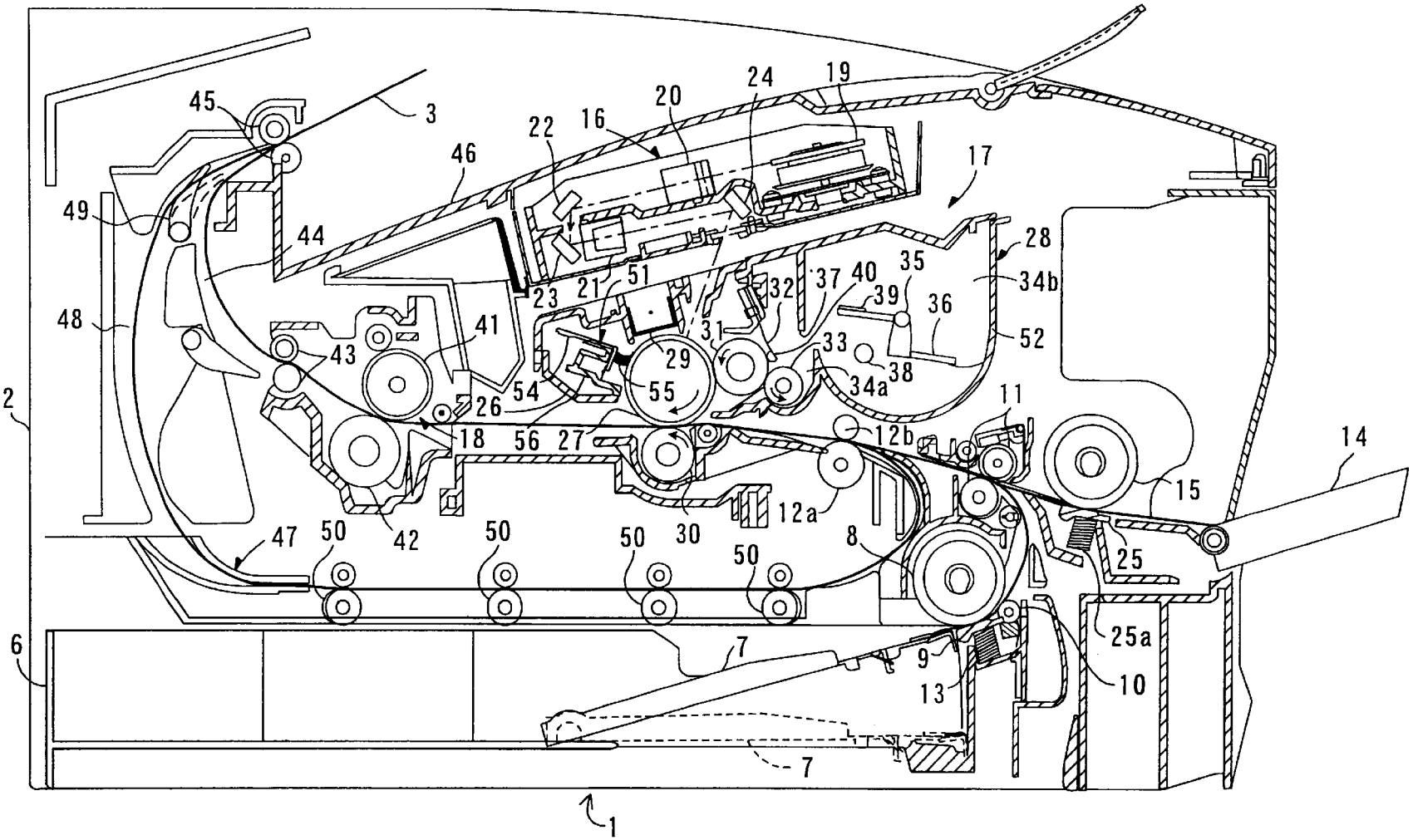
FIG. 1 is a side sectional view of principal parts of a laser printer.

FIG. 1 is a side sectional view of the principal parts of a laser printer 1 according to an embodiment of the invention. A sheet feed tray 6 is detachably attached to a bottom portion of a casing 2. A presser plate 7 is provided in the sheet feed tray 6 to support and upwardly press sheets 3 stacked in the sheet feed tray 6. A sheet feed roller 8 and a sheet feed pad 9 are provided above one end of the sheet feed tray 6, and register rollers 12*a*, 12*b* are provided downstream from the sheet feed roller 8 with respect to the sheet conveying direction.

The presser plate 7 allows sheets 3 to be stacked thereon. The presser plate 7 is pivotally supported at its end remote from the sheet feed roller 8 such that the presser plate 7 is vertically movable at its end closest to the sheet feed roller 8. The presser plate 7 is urged upwardly from its reverse, or bottom, side by a spring (not shown). When the stack of sheets 3 increases in quantity, the presser plate 7 swings downwardly about the end of the presser plate 7 remote from the sheet feed roller 8, against the urging force of the spring. The sheet feed roller 8 and the sheet feed pad 9 are disposed facing each other. The sheet feed pad 9 is urged toward the sheet feed roller 8 by a spring 13 disposed on the reverse side of the sheet feed pad 9.

An uppermost sheet 3 in the stack on the presser plate 7 is pressed against the sheet feed roller 8 by the spring provided on the reverse side of the presser plate 7, and the uppermost sheet 3 is pinched between the sheet feed roller 8 and the sheet feed pad 9 when the sheet feed roller 8 rotates. Thus, the sheets 3 are fed one by one from the top of the stack.

After paper dust is removed from the sheet 3 by a paper dust removing roller 10, the sheet 3 is conveyed by conveyer rollers 11 to the register rollers 12*a*, 12*b*. The register rollers 12*a*, 12*b* comprise a driving roller 12*a* provided in the casing 2 and a driven roller 12*b* provided in a process unit 17, which will be described later. The driving roller 12*a* and the driven roller 12*b* make a surface-to-surface contact with each other. The sheet 3, conveyed by the conveyor rollers 11, is further conveyed downstream while being pinched between the driving roller 12*a* and the driven roller 12*b*.

The driving roller 12*a* is not driven before the sheet 3 makes contact with the driving roller 12*a*. After the sheet 3 makes contact with the driving roller 12*a* and the driving roller 12*a* corrects the orientation of the sheet 3, the driving roller 12*a* rotates and conveys the sheet 3 downstream.

A manual feed tray 14, from which sheets 3 are manually fed, and a manual feed roller 15, that feeds sheets 3 stacked on the manual feed tray 14, are provided at the front of the casing 2. A separation pad 25 is disposed facing the manual feed roller 15. The separation pad 25 is urged toward the manual feed roller 15 by a spring 25*a* disposed on the reverse, or bottom, side of the separation pad 25. The sheets 3 stacked on the manual feed tray 14 are fed one by one while being pinched by the manual feed roller 15 and the separation pad 25 when the manual feed roller 15 rotates.

The casing 2 further holds a scanner unit 16, the process unit 17, and a fixing unit 18. The scanner unit 16 is provided in an upper portion of the casing 2 and has a laser emitting portion (not shown), a rotatable polygonal mirror 19, lenses 20, 21, and reflecting mirrors 22, 23, 24. A laser beam, emitted from the laser emitting portion, is modulated based on predetermined image data. The laser beam sequentially passes through or reflects from the optical elements, that is, the polygonal mirror 19, the lens 20, the reflecting mirrors 22, 23, the lens 21, and the reflecting mirror 24 in order as indicated by a broken line in FIG. 1. The laser beam is thus directed to and scanned at a high speed over the surface of a photosensitive drum 27, which will be described later.

Figure 2:
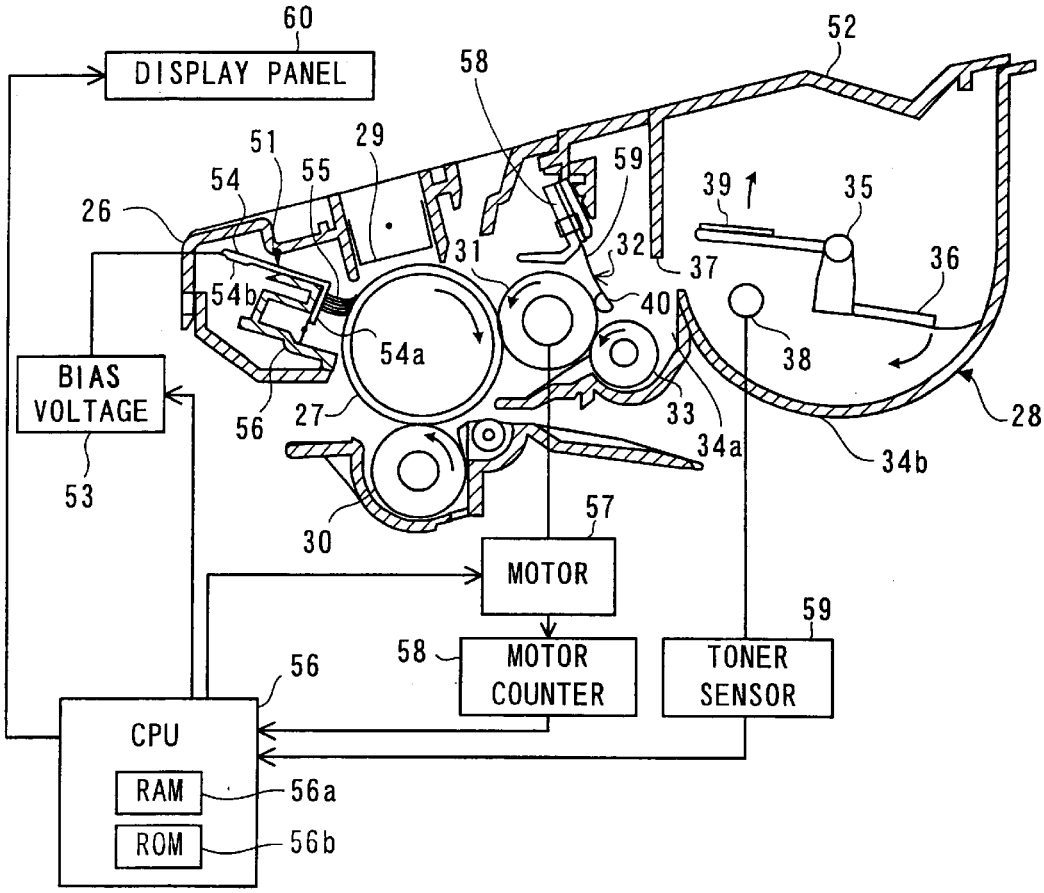
FIG. 2 is a side sectional view of principal parts of a process unit of the laser printer shown in FIG. 1.

FIG. 2 is an enlarged sectional view of the process unit 17. As shown in FIG. 1, the process unit 17 is disposed below the scanner unit 16 and has a drum cartridge 26 detachably attached to the casing 2 and a developing cartridge 28 detachably attached to the drum cartridge 26. The drum cartridge 26 includes the photosensitive drum 27, a scorotron charger 29, a transfer roller 30 and a brush 51, as a paper dust removing element, made of electrically conductive material.

The developing cartridge 28 includes a developing roller 31, a layer thickness-regulating blade 32, a supply roller 33, a developing chamber 34*a*, and a toner box 34*b*, all of which are provided within a housing 52 of the developing cartridge 28.

The toner box 34*b* contains positively charged nonmagnetic single-component toner as a developing agent. The toner used in this embodiment is a polymerized toner obtained through copolymerization of styrene-based monomers, such as styrene, and acryl-based monomers, such as acrylic acid, alkyl (C1–C4) acrylate, or alkyl (C1–C4) methacrylate, using a known polymerization method, such as suspension polymerization. The particle shape of such a polymerized toner is spherical, and thus the polymerized toner has excellent flowability.

A coloring agent, such as carbon black, and wax are added to the polymerized toner. An external additive, such as silica, is also added to the polymerized toner to improve flowability. The particle size of the polymerized toner is approximately 6–10 $\mu$m.

The toner in the toner box 34*b* is stirred by an agitator 36 supported by a rotating shaft 35 provided at a central portion of the toner box 34*b*, and is discharged from a toner supply port 37 opened on one side of the toner box 34*b*, toward the developing chamber 34*a*. A toner detection window 38 is provided on a side wall of the toner box 34*b*. The toner detection window 38 is wiped clean by a cleaner 39 supported by the rotating shaft 35.

The supply roller 33 is disposed diagonally downward from the toner supply port 37 so as to be rotatable in a counterclockwise direction as indicated by an arrow. The developing roller 31 is disposed facing the supply roller 33 so as to also be rotatable in a counterclockwise direction as indicated by an arrow. The supply roller 33 and the developing roller 31 are disposed in contact with each other so that they are press-deformed against each other to an appropriate extent. The supply roller 33 is formed by covering a metallic shaft 33*a* with a conductive sponge material 33*b*.

The developing roller 31 is formed by covering a metallic roller shaft with an electrically conductive rubber material. More specifically, the developing roller 31 is covered with an electrically conductive urethane or silicone rubber containing fine carbon particles, and coated with a urethane or silicone rubber containing fluorine. A developing bias of approximately 300V–400V is applied to the developing roller 31 with respect to the photosensitive drum 27.

The layer thickness-regulating blade 32 is disposed near the developing roller 31 to regulate the thickness of a toner layer formed on the surface of the developing roller 31. The layer thickness-regulating blade 32 has a metallic plate spring 59 and a presser portion 40. The presser portion 40 is disposed on a distal end of the plate spring 59 and is formed from an electrically insulative silicone rubber having a semicircular shape in cross-section. The plate spring 59 is supported to the housing 52, at its end opposite to the distal end of the plate spring 59, by a support member 58 so as to be close to the developing roller 31. The presser portion 40 is pressed against the developing roller 31 by the elastic force of the plate spring 59.

As shown in FIG. 2, toner discharged by the agitator 36 from the toner supply port 37 to the developing chamber 34*a* is supplied to the developing roller 31 when the supply roller 33 rotates. Toner is positively charged between the supply roller 33 and the developing roller 31 due to friction. Toner supplied to the developing roller 31 passes between the presser portion 40 and the developing roller 31 and is further sufficiently positively (in this embodiment) charged therebetween due to friction. After passing between the presser portion 40 and the developing roller 31, toner is formed into a thin layer of a predetermined thickness on the developing roller 31.

The photosensitive drum 27 is rotatably mounted to rotate in a clockwise direction, as indicated by an arrow, in the drum cartridge 26 so as to be in contact with the developing roller 31. The photosensitive drum 27 is formed by coating a grounded cylindrical aluminum drum with a positively charged photosensitive layer made of polycarbonate.

The scorotron charger 29 is disposed at a predetermined distance from the photosensitive drum 27. The scorotron charger 29 produces a corona discharge from a tungsten wire and positively charges the surface of the photosensitive drum 27 uniformly. The scorotron charger 29 is designed to charge the surface of the photosensitive drum 27 to a potential of approximately 870V.

The transfer roller 30 is disposed below the photosensitive drum 27 and is supported to rotate, in a counter-clockwise direction as indicated by an arrow, by the drum cartridge 26 so as to face the photosensitive drum 27. The transfer roller 30 is formed by covering a metallic roller shaft with an electrically conductive rubber material. A power source (not shown) is electrically connected to the roller shaft such that a predetermined transfer bias is applied to the roller shaft when toner on the photosensitive drum 27 is transferred to the sheet 3. The transfer bias is a negative bias and is controlled to a constant current of approx. −12 $\mu$A.

An electrically conductive brush 51 is disposed facing the photosensitive drum 27 at a position downstream from the transfer roller 30 and upstream from the scorotron charger 29 with respect to the rotation direction of the photosensitive drum 27.

The electrically conductive brush 51 has a substantially L-shaped metallic base member 54 and a brush 55 made of electrically conductive filaments inserted in one end 54*a* of the base member 54. The other end 54*b* of the base member 54 is attached to a brush frame 56 disposed near the photosensitive drum 27 and integrally formed to the drum cartridge 26. The brush 55 is located so as to make contact with the surface of the photosensitive drum 27 at its free end.

The base member 54 of the electrically conductive brush 51 is connected to a bias power supply 53 that applies a cleaning bias so as to create a potential difference between the brush 55 and the photosensitive drum 27.

The brush 55 of the electrically conductive brush 51 is inserted in the base member 54 such that fine filaments of less than 10 deniers are used and the density is greater than 50,000 filaments/square inch. Specifically, the brush 55 is constructed of electrically conductive filaments in which electrically conductive particles or fillers of carbon are dispersed into an insulating base material of nylon, acrylic, or rayon at a low density, and a volume resistance is $10^9\Omega$ cm or more at 20% relative humidity and $10^8\Omega$ cm or less at 80% relative humidit is attained.

One denier is the density of a thread having a mass of 1 gram per 9,000 meters of length.

If a density of a material made of a filament is 1.2 g/ml, the material of one gram has a volume of 1/1.2 ml. A cross sectional area S of the filament when expanded to 9,000 meters is determined as follows:

$$S=1/1.2/900000=9.26\times10^{-7}\ \text{cm}^2.$$

As the filament is considered to expand in circular form, its diameter (2r) is determined as follows:

$$2r=2\times(S/\pi)^{1/2}=2\times(9.26\times10^{-7}/\pi)^{1/2}=10.86\times10^{-4}\ \text{cm}.$$

That is, the diameter of the filament of one denier is approximately 10 $\mu$m.

The brush 55 is constructed wherein the filaments having a thickness of 300 deniers for 48 filaments are inserted in an area 226 mm×4 mm at a density of 100,000 filaments per square inch (or 15, 500 filaments per squire centimeter or 155 filaments per square millimeter). The total number of filaments, the total number of deniers, and the total cross sectional area of the brush 55 are determined as follows:

The total number of filaments=area×density=(226×4)×100000/25.4$^2$=140120 filaments wherein 1 inch=25.4 mm The total number of deniers=140120×300/48=875750 deniers Total cross sectional area=875750×S=0.81 cm$^2$ The relationship between a volume resistance R and a volume resistance Rv of the brush 55 is expressed as follows:

$$R=Rv\times\text{trim length/total cross sectional area}.$$

Thus, the volume resistance Rv is calculated using formula 1 as follows:

$$Rv=R\times\text{total cross sectional area/trim length} \qquad \text{Formula 1}$$

Figure 10:
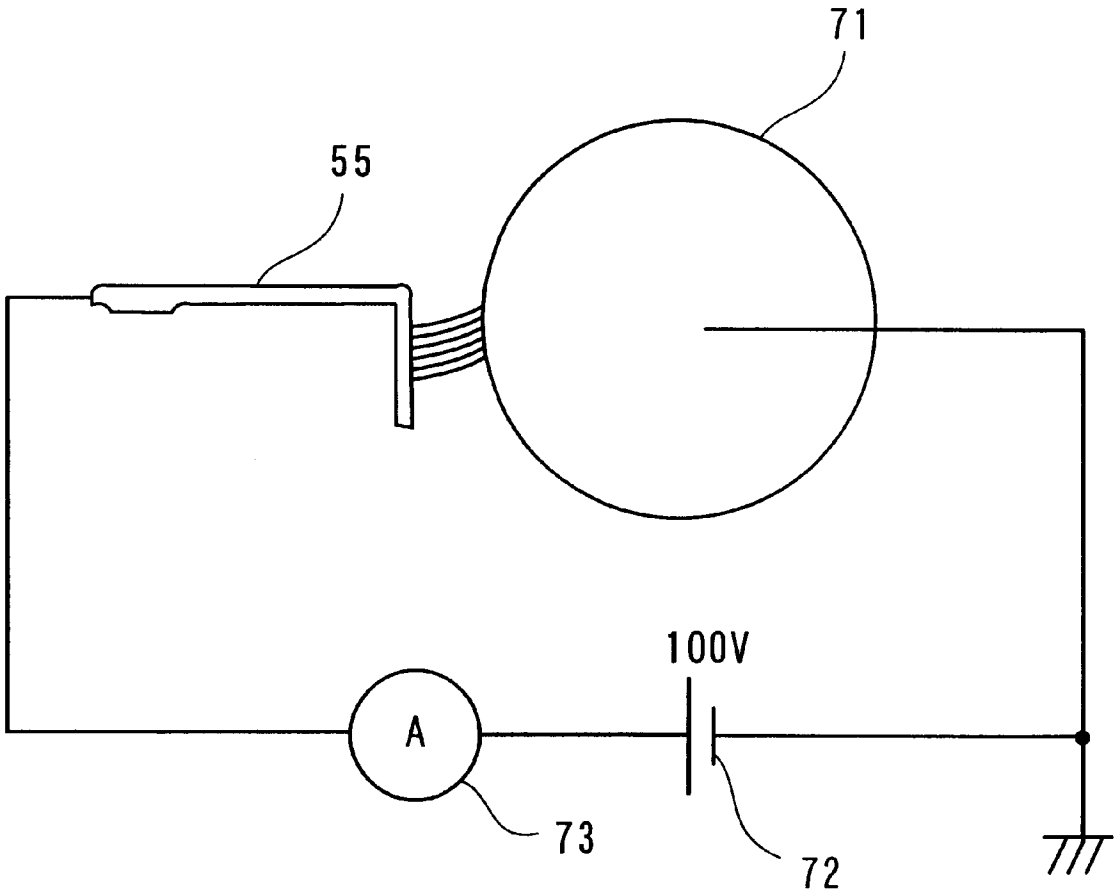
FIG. 10 illustrates how to measure a resistance of a brush.

The resistance of the brush 55 is obtained as shown in FIG. 10. With the brush 55 in contact with the aluminum tube 71, a voltage of 100V is applied between the brush 55 and the aluminum tube 71 through the power supply 72, and a current is measured with the ammeter 73. The resistance R [Ω] is calculated using the following formula:

$$R=100/\text{current}\ [A]$$

As shown in FIG. 1, the fixing unit 18 is disposed downstream from the process unit 17 and has a heat roller 41, a pressure roller 42 pressed against the heat roller 41, and a pair of conveying rollers 43 provided downstream from the heat roller 41 and the pressure roller 42. The heat roller 41 is formed by an aluminum tube coated with a silicone rubber and has a halogen lamp placed in the tube. Heat generated from the halogen lamp is transferred to the sheet 3 through the aluminum tube. The pressure roller 42 is made of a silicone rubber, which allows the sheet 3 to be easily removed from the heat roller 41 and the pressure roller 42.

The toner transferred to the sheet 3 by the process unit 17 melts and becomes fixed onto the sheet 3 due to the applied heat, while the sheet 3 passes between the heat roller 41 and the pressure roller 42. After the fixation is complete, the sheet 3 is conveyed downstream by the conveying rollers 43.

An ejecting path 44 is formed downstream from the conveying rollers 43 to reverse the sheet conveying direction and guide the sheet 3 to an output tray 46 provided on the top surface of the laser printer 1. A pair of ejecting rollers 45 is provided at the upper end of the ejecting path 44 to eject the sheet 3 to the output tray 46.

The laser printer 1 is provided with a reverse conveying unit 47 that allows image forming on the both sides of the sheet 3. The reverse conveying unit 47 includes the ejecting rollers 45, a reverse conveying path 48, a flapper 49, and a plurality of pairs of reverse conveying rollers 50.

The pair of ejecting rollers 45 can be switched between forward and reverse rotation. The ejecting rollers 45 rotate forward to eject the sheet 3 to the output tray 46, and rotate in reverse to reverse the sheet conveying direction.

The reverse conveying path 48 is substantially vertical to guide the sheet 3 from the ejecting rollers 45 to the reverse conveying rollers 50 disposed above the sheet feed tray 6. The upstream end of the reverse conveying path 48 is located near the ejecting rollers 45, and the downstream end of the reverse conveying path 48 is located near the reverse conveying rollers 50.

The flapper 49 is swingably provided adjacent to a point branching into the ejecting path 44 and the reverse conveying path 48. The flapper 49 can be shifted between a first position shown by solid line and a second position shown by broken line in FIG. 1. The flapper 49 is shifted by switching the excited state of a solenoid (not shown).

When the flapper 49 is at the first position, the sheet 3 guided along the ejecting path 44 is ejected by the ejecting rollers 45 to the output tray 46. When the flapper 49 is at the second position, the sheet 3 is conveyed to the reverse conveying path 48 by the ejecting rollers 45 rotating in reverse.

The plurality of pairs of reverse conveying rollers 50 are provided above the sheet feed tray 6 in a horizontal direction. The pair of reverse conveying rollers 50 on the most upstream side are located near the lower end of the reverse conveying path 48. The pair of reverse conveying rollers 50 on the most downstream side are located substantially below the register rollers 12*a*, 12*b*.

The operation of the reverse conveying unit 47, when an image is formed on the both sides of the sheet 3, will be described. The sheet 3, with a printed image on one side thereof, is conveyed by the conveying rollers 43 along the ejecting path 44 toward the ejecting rollers 45. At this time, the flapper 49 is located in the first position. The ejecting rollers 45 rotate forward while pinching the sheet 3 to convey the sheet 3 temporarily toward the output tray 46. The ejecting rollers 45 stop rotating forward when the sheet 3 is almost ejected to the output tray 46 and the trailing edge of the sheet 3 is pinched by the ejecting rollers 45. In this state, the flapper 49 is shifted to the second position, and the ejecting rollers 45 rotate in reverse. The sheet 3 is conveyed in the reverse direction along the reverse conveying path 48. After the entire sheet 3 is conveyed to the reverse conveying path 48, the flapper 49 is returned to the first position.

After the above actions have occurred, the sheet 3 is conveyed to the reverse conveying rollers 50, and conveyed upward by the reverse conveying rollers 50 to the register rollers 12. The sheet 3 is then conveyed to the process unit 17 with its printed side facing down. As a result, an image is printed on both sides of the sheet 3.

The image forming operation will now be described. The surface of the photosensitive drum 27 is uniformly positively charged by the scorotron charger 29. The surface potential of the photosensitive drum 27 is approximately 870V. When the surface of the photosensitive drum 27 is irradiated with a laser beam emitted from the scanner unit 16, the electric charge is removed from the portion exposed by the laser beam, and the surface potential of the exposed portion becomes approximately 50V–100V.

In this way, the surface of the photosensitive drum 27 is divided into a high-potential portion (unexposed portion) and a low-potential portion (exposed portion), and thereby an electrostatic latent image is formed. The surface potential of the unexposed portion is approximately 870V, while the surface potential of the exposed portion is approximately 50V–100V.

When positively charged toner on the developing roller 31 faces the photosensitive drum 27, the toner is supplied to the low-potential exposed portion of the photosensitive drum 27. As a result, the electric latent image formed on the photosensitive drum 27 becomes visible.

The developing roller 31 reclaims the toner remaining on the surface of the photosensitive drum 27. The remaining toner is the toner that has been supplied to the photosensitive drum 27 but is not transferred by the transfer roller 30 from the photosensitive drum 27 to the sheet 3. The remaining toner adheres to the developing roller 31 by a Coulomb force generated due to a potential difference between the photosensitive drum 27 and the developing roller 31, and is reclaimed into the developing cartridge 28.

With this method, a scraper that scrapes the remaining toner from the photosensitive drum 27 and a storage place for the scraped toner are not required. Thus, the laser printer can be simplified in structure and made compact. Further, manufacturing costs are reduced.

While the sheet 3 is passing between the photosensitive drum 27 and the transfer roller 30, the toner forming a visible image on the photosensitive drum 27 is transferred to the sheet 3 by a Coulomb force generated due to a potential difference between the potential of the sheet 3 and the surface potential of the photosensitive drum 27. After toner is transferred to the sheet 3, the surface potential of the unexposed portion of the photosensitive drum 27 becomes approximately 250V.

When the toner is transferred to the sheet 3, the photosensitive drum 27 makes contact with the sheet 3, so that paper dust found on the sheet 3 adheres to the surface of the photosensitive drum 27. Along with the rotation of the photosensitive drum 27, the paper dust is physically collected by the brush 55 of the electrically conductive brush 51, and further electrostatically caught by the cleaning bias applied from the bias power supply 53.

The sheet 3 is conveyed to the fixing unit 18 and, as described above, the toner on the sheet 3 melts and becomes fixed onto the sheet 3 due to the applied heat. After passing along the ejecting path 44, the sheet 3, on which the toner is fixed, is ejected to the output tray 46.

FIG. 2 illustrates a block diagram of a control system of the laser printer 1. In FIG. 2, a CPU 56 is connected to the bias power supply 53, a motor 57 for driving the developing roller 31, a motor counter 58 for counting the number of revolutions of the motor 57, a toner sensor 59 that detects the remaining quantity of toner, and a display panel 60 that displays a setting status of each part of the laser printer 1.

The CPU 56 includes a RAM **56*a* and a ROM 56*b* and controls each unit. The RAM 56*a* stores temporary values inputted by the motor counter 58 and the toner sensor 59. The ROM 56*b* stores control programs for the motor 57, the bias power supply 53, and the display panel 60. The RAM 56*a* is structured so as to maintain its contents by use of a backup power supply, storing various setting values even with the power of the laser printer 1** off.

The bias power supply 53 is connected to the base member 54 of the electrically conductive brush 51 and outputs a specified cleaning bias based on the control of the CPU 56 during image forming operation, as described above.

An output shaft of the motor 57 is connected to the developing roller 31 via a line of gears (not shown). The motor 57 is connected to driving parts, such as the sheet feed roller 8, the photosensitive drum 27, and the heat roller 41, via a line of gears, not shown. The operation of the motor 57 is controlled based on the control of the CPU 56 during the image forming operation. That is, the operations of the developing roller 31 and other driving parts are controlled by the CPU 56. The motor counter 58 is connected to the motor 57, and counts the number of revolutions of the motor 57 and outputs the count. The output number of revolutions is stored in the RAM **56*a* of the CPU 56**.

The toner sensor 59 is a light sensor including a light emitting part and a light receiving part. The light emitting part and the light receiving part are disposed outside windows 38 provided in both side walls of the toner box **34*b* so as to face each other via the windows 38. A light beam emitted from the light emitting part, passes into the toner box 34*b* through one window 38, out of the toner box 34*b* through the other window 38**, and is detected by the light receiving part.

The toner sensor 59 converts a light beam received by the light receiving part into a numeric value and outputs it to the CPU 56. The CPU 56 determines the amount of light detected by the light receiving part based on the value sent from the toner sensor 59, and compares the amount of light emitted from the light emitting part and the amount of light detected by the light receiving part. Further, the CPU 56 determines whether the amount of toner remaining in the toner box **34*b* is sufficient for image formation based on the comparison. If the amount of toner is insufficient, the CPU 56 causes the display panel 60** to display a toner empty message.

The display panel 60 is a liquid crystal display or LCD provided on the top of the casing 2, and displays the current status of the laser printer 1.

The cleaning bias to be applied to the electrically conductive brush 51 is controlled according to the number of images formed after the start of use of a new developing cartridge 28 filled with toner (hereinafter referred to as the image formation amount). Specifically, the cleaning bias is controlled according to the image formation amount after the user uses the laser printer 1 for the first time or the user replaces an empty developing cartridge 28 with a new one.

When a new developing cartridge 28 is installed in the casing 2 by the user after toner empty is detected, the CPU 56 detects that the toner empty status is cancelled based on a signal from the toner sensor 59, and sets the image formation amount to the default, i.e., start, value.

In addition, when the user turns on the power of the laser printer 1 for the first time after purchase, the image formation amount is set to the default value. The image formation amount is stored in the RAM 56*a* and will not be reset even when the laser printer 1 is powered off and on again. Even if the developing cartridge 28 is removed to clear a paper jam error and then reattached, the image formation amount remains stored in the RAM 56*a* without being reset.

That is, after the laser printer 1 is turned on for the first time, the image formation amount is not set to the default value until toner empty is detected and the developing cartridge 28 is replaced with a new one.

In the embodiment, the CPU 56 controls the bias power supply 53 and outputs a specified cleaning bias so as to create a potential difference, to attract paper dust on the surface of the photosensitive drum 27 to the electrically conductive brush 51, between the photosensitive drum 27 and the brush 55 of the electrically conductive brush 51. The cleaning bias is a positive bias voltage to attract paper dust, which is negatively charged. The potential difference created between the photosensitive drum 27 and the brush 55 of the electrically conductive brush 51 is controlled so as to become smaller with an increase in the image formation amount.

By controlling the cleaning bias in this manner, the paper dust on the photosensitive drum 27 is attracted to, and is reliably caught by, the electrically conductive brush 51.

An accumulated operation time of the developing roller 31, which is calculated based on the number of revolutions of the motor 57 inputted from the motor counter 58 to the CPU 56, can be used as the image formation amount. The accumulated operation time is reset when the image formation amount is set to the default value as described above. The motor counter 58 may also count the operation time of the motor 57 and output it to the CPU 56.

Figure 3:
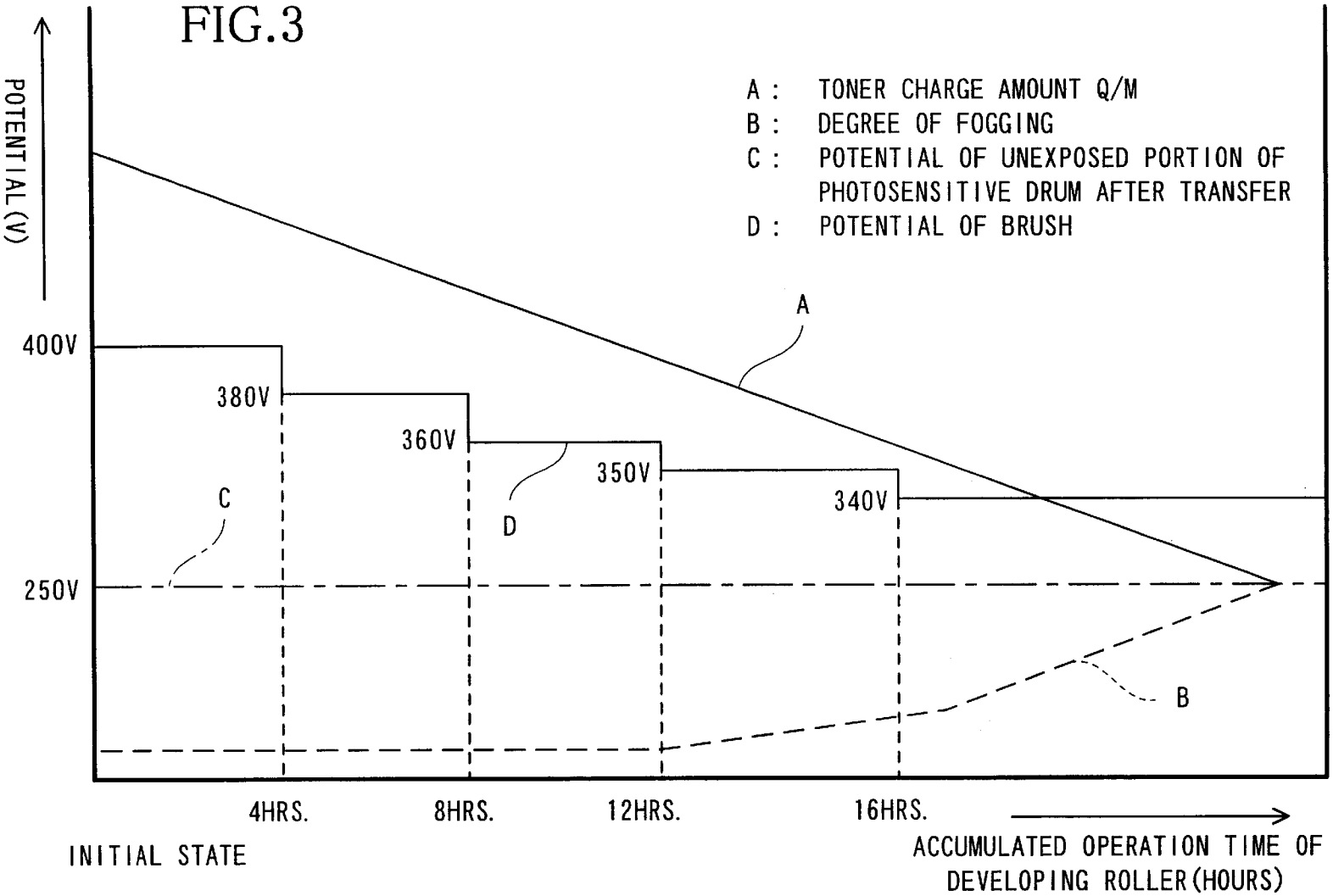
FIG. 3 is a graph illustrating a control of the cleaning bias of the laser printer shown in FIG. 1 based on the accumulated operation time of the developing roller.

The following is a description of the control of the cleaning bias according to the image formation amount. In FIG. 3, the bias power supply 53 is controlled to reduce the potential of the brush 55, as shown by a solid line D, to be gradually reduced as the accumulated operation time of the developing roller 31 increases from its initial state. As a result, the potential difference between the potential of the photosensitive drum 27, shown by an alternate long and short dash line C and the potential of the brush 55 is reduced in stages.

As shown in FIG. 3, the potential of the brush 55 at its initial state is set to approx. 400V, which is lower than approx. 600V where electric discharge occurs between the brush 55 and the photosensitive drum 27, and higher than approx. 250V which is the surface potential of the unexposed portion of the photosensitive drum 27 after transferring the image.

In addition, the potential of the brush 55 is set so as to become smaller by approx. 10–20V after every four hours of use passes from its initial (start or new) state. The CPU 56 controls the bias power supply 53 to output the cleaning bias such that, as shown in FIG. 3, the potential of the brush 55 may be decreased to approximately 380V after four hours from the initial state, 360V after eight hours from the initial state, 350V after 12 hours from the initial state, and 340V after 16 hours from the initial state.

340V, which is the potential of the brush 55 obtained after the passage of 16 hours from the initial state, is a necessary potential to create a minimum potential difference between the brush 55 and the photosensitive drum 27 that makes it possible to electrically catch the paper dust. After 16 hours or later from the initial state, the bias power supply 53 is controlled such that the potential of the brush 55 can be maintained at 340V.

In the laser printer 1 of the embodiment, the print speed is 20 pages per minute (ppm) for A4-size portrait printing. While the developing roller 31 is operated for four hours, approximately 1,000 pages of A4-sized paper are printed because the developing roller 31 actually rotates both before and after a page is printed to allow for warm up and achieve and maintain a stable speed for printing. Therefore, when 16 hours have passed from the initial state, approximately 4,000 pages have been printed.

In FIG. 3, a solid line A indicates an amount of charge per unit mass of the toner remaining on the photosensitive drum 27 after toner is transferred to a sheet (hereinafter referred to as toner charge amount Q/M). As shown in FIG. 3, the toner charge amount Q/M is linearly reduced as the accumulated operation time of the developing roller 31 increases.

That is, in the initial state, toner has the same polarity and a sufficient amount of charge because it is new. However, as the accumulated operation time of the developing roller 31 increases, the toner deteriorates and becomes poorly charged, so that the toner charge amount Q/M gradually decreases.

A broken line B of FIG. 3 indicates an amount of emergence of fogging, which remarkably increases once the accumulated operation time exceeds a specified time (12 hours). Fogging is a state in which toner is dispersed over the background of images, such as text formed on a sheet. It is caused by the poorly charged toner, which adheres to all of the surface of the photosensitive drum 27 except for a latent image, and is transferred to the sheet 3.

Toner, which deteriorates as the accumulated operation time elapses, contains opposite polarity toner, which is charged negatively, the same as the paper dust. The proportion of the opposite polarity toner increases as the time elapses. When the opposite polarity toner faces the brush 55, it is caught by the brush 55 along with the paper dust. As a result, the ability of the brush 55 to remove paper dust deteriorates gradually.

On the other hand, the effect of the paper dust on the image quality tends to appear as the toner charge amount Q/M is higher, and the effect is unlikely to appear as the toner charge amount Q/M is lower.

In the laser printer 1 of the embodiment, in the initial state or when the toner charge amount Q/M is high, the bias power supply 53 is controlled to maintain the potential of the brush 55 at approximately 400V. The potential of the brush 55 is set higher than 250V, which is the potential of the unexposed portion of the surface of the photosensitive drum 27 after transferring, so as to maintain a sufficient potential difference (approximately 150V) between the photosensitive drum 27 and the brush 55.

In the initial state, deterioration of toner does not proceed, and there is little opposite polarity toner. Thus, the potential difference between the photosensitive drum 27 and the brush 55 is provided as great as possible so that the brush 55 can reliably attract the paper dust adhered on the photosensitive drum 27.

The potential of the brush 55 in the initial state is approximately 400V, which is lower than approximately 600V where the electric discharge occurs between the brush 55 and the photosensitive drum 27. When an electric discharge occurs between the brush 55 and the photosensitive drum 27, the paper dust collected in the brush 55 is released to the photosensitive drum 27, causing deterioration in the image quality. According to the embodiment, through the application of a bias such that an electric discharge between the brush 55 and the photosensitive drum 27 does not occur, favorable image quality can be achieved.

As the toner charge amount (Q/M) decreases with the passage of the accumulated operation time of the developing roller 31, the potential of the brush 55 is gradually decreased to approximately 380V, 360V, 350V, respectively, every four hours starting from the initial state, as described above. Accordingly, the potential difference between the brush 55 and the photosensitive drum 27 is gradually decreased to approximately 130V, 110V, and 100V.

As the accumulated operation time of the developing roller 31 increases, the deterioration of toner proceeds, and the charged state of the toner varies. As the time elapsed from the initial state becomes long, the toner charge amount Q/M decreases, and the proportion of the opposite polarity toner increases in the toner box 34*b*.

The potential difference between the photosensitive drum 27 and the brush 55 is controlled so as to decrease in stages according to the increase of the proportion of the opposite polarity toner, thereby keeping a state where the opposite polarity toner is unlikely to adhere to the brush 55. Thus, the reduction in the ability of the electrically conductive brush 51 to remove paper dust and filming on the photosensitive drum 27 can be suppressed, which contributes to favorable image formation.

As shown in FIG. 3, when the amount of emergence of fogging increases after 16 hours from the initial state, a cleaning bias is applied to the brush 55 such that the potential of the brush 55 finally becomes approximately 340V, and the potential difference between the photosensitive drum 27 and the brush 55 becomes approximately 90V. The potential difference of approximately 90V is the lowest one at which the brush 55 can electrically collect the paper dust from the photosensitive drum 27.

Even when the final potential difference between the photosensitive drum 27 and the brush 55 becomes approximately 90V, the brush 55 can catch paper dust electrically and prevent toner adhesion, thereby catching paper dust reliably from the initial state to the final state.

As described above, the laser printer 1 of the embodiment controls the bias power supply 53 to apply the cleaning bias to the electrically conductive brush 51 so as to decrease the potential difference between the photosensitive drum 27 and the brush 55 in stages with the passage of accumulated operation time of the developing roller 31. This simple control effectively prevents the opposite polarity toner, which increases with the passage of time, from adhering to the brush 55.

According to the laser printer 1 of the embodiment, when the developing cartridge 28 is replaced with a new developing cartridge 28 to cancel the toner empty status, the image formation amount stored in the RAM 56*a* is reset to default. Thus, only with the replacement of the developing cartridge 28, which is empty, with a new one, which is filled with toner, the control of the bias power supply 53 by the CPU returns control to the initial state, which improves usability.

Because the accumulated operation time of the developing roller 31 is used as the image formation amount, the cleaning bias to be applied to the electrically conductive brush 51 can be controlled in accordance with the time when the toner is actually supplied from the developing roller 31 to the photosensitive drum 27. Thus, the brush 51 can receive a proper cleaning bias to cope with a change of the charged status due to the deterioration of toner, that is, a reduction of the toner charge amount Q/M, thereby preventing toner from adhering to the brush 55.

The brush 55, which is electrically conductive, can improve the effect of the cleaning bias applied from the bias power supply 53, and electrically catch the paper dust adhered to the photosensitive drum 27.

The brush 55 of the electrically conductive brush 51 is provided at a part that makes contact with the surface of the photosensitive drum 27, so that the paper dust on the photosensitive drum 27 can be collected physically as well as electrically.

Usually, toner has a greater adhesion to the photosensitive drum 27 than the paper dust has. The brush 55 satisfactorily collects paper dust alone, without collecting toner from the photosensitive drum 27. Toner adhesion to the electrically conductive brush 51 is prevented, so that paper dust can be removed effectively.

The laser printer 1 of the embodiment uses substantially spherical-shaped polymerized toner. The spherical toner resists being removed by the electrically conductive brush 51 because its adhesion to the photosensitive drum 27 is great. This further suppresses physical removal of the toner by the electrically conductive brush 51. Therefore, the electrically conductive brush 51 can effectively remove paper dust.

In the laser printer 1 of the embodiment, toner and the photosensitive drum 27 are charged with positive polarity, and the transfer roller 30 receives a negative transfer bias. Paper dust moving from the sheet 3 to the photosensitive drum 27 during transference becomes the same polarity as the transfer bias, that is, negative polarity. However, paper dust is inherently prone to being charged negatively.

If electric charge polarity of the toner and the photosensitive drum 27 is positive, paper dust negatively charged is likely to adhere to the photosensitive drum 27. Thus, removing the paper dust from the photosensitive drum 27 with the electrically conductive brush 51 is extremely important to obtain high quality images.

In the laser printer 1 of the embodiment, the toner remaining on the photosensitive drum 27 is collected by the developing roller 31. If paper dust adheres to the photosensitive drum 27, the paper dust is collected along with toner by the developing roller 31, so that the toner and the paper dust are included in the toner box 34*a*. The paper dust in the toner box 34*a* detrimentally affects the image quality. However, with the use of the electrically conductive brush 51, such paper dust can be effectively removed, so that favorable images can be formed while reusing the toner remaining on the photosensitive drum 27.

In the embodiment, the accumulated operation time of the developing roller 31 is used as the image formation amount. However, instead of the accumulated operation time, the number of pages printed, which is added up based on new page commands obtained from image data inputted on a personal computer during a printing process, may be used as the image formation amount. The accumulated number of pages printed is also reset to the initial, or start, value, as in the case of the above embodiment, every time the initial state is established.

Figure 4:
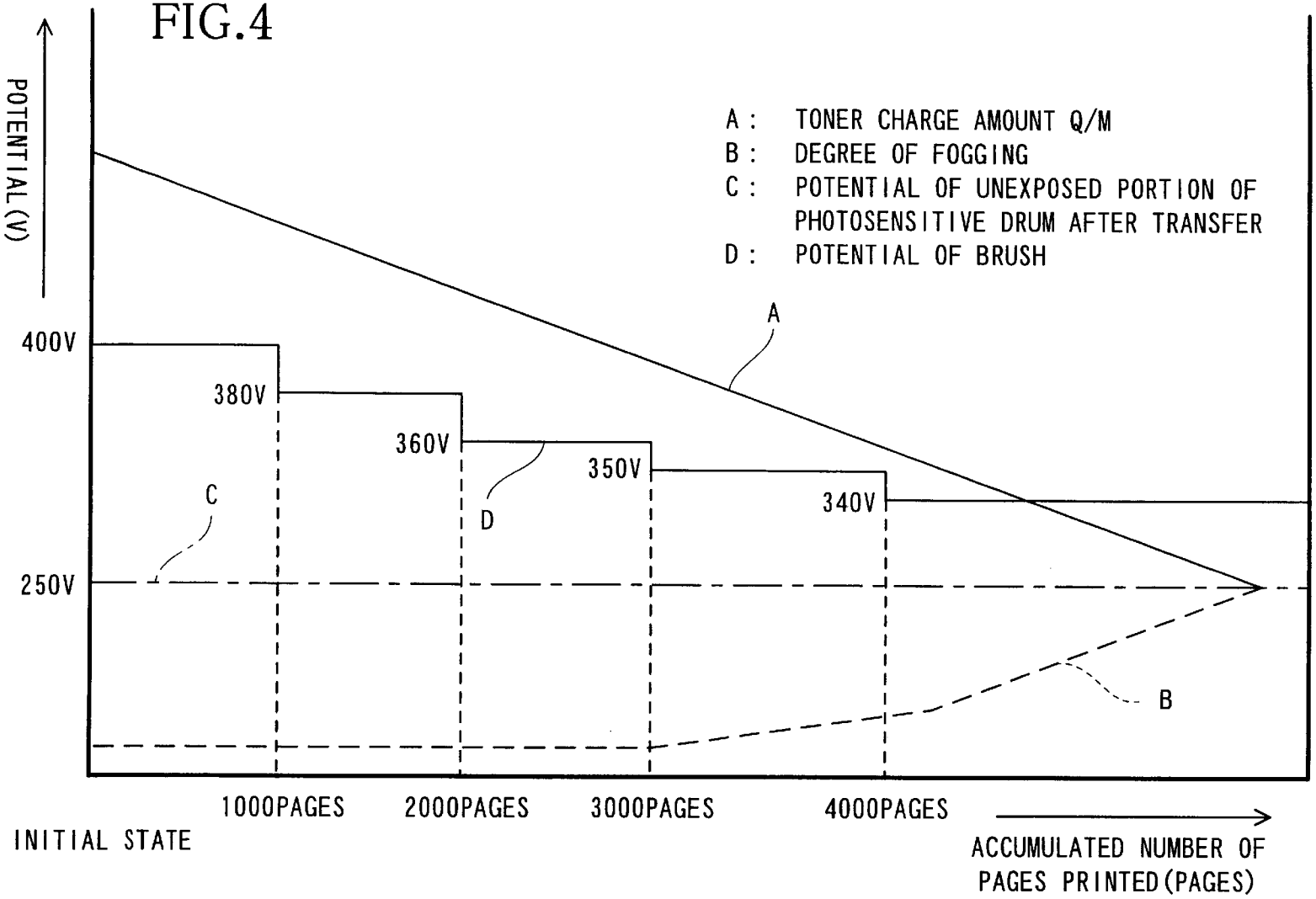
FIG. 4 is a graph illustrating the control of the cleaning bias of the laser printer shown in FIG. 1 based on the accumulated number of pages printed.

The bias power supply 53 is controlled to maintain the potential of the brush 55 at approximately 400V from the initial state until 1,000 pages are printed, as shown in FIG. 4. The potential of the brush 55 is set so as to decrease by 10–20V every time 1,000 pages are printed.

Specifically, the CPU 56 controls the bias power supply 53 to output the cleaning bias such that the potential of the brush 55 can be gradually decreased to approximately 380V after 1,000 pages are printed from the initial state, 360V after 2,000 pages are printed from the initial state, 350V after 3,000 pages are printed from the initial state, and 340V after 4,000 pages are printed from the initial state.

With the increase in the accumulated number of pages printed, the toner deteriorates, and the charged state of the toner changes. In addition, the toner charge amount Q/M decreases, and the proportion of the opposite polarity toner increases in the toner box 34*b*.

The potential difference between the photosensitive drum 27 and the brush 55 is controlled so as to decrease in stages according to the increase of the proportion of the opposite polarity toner, thereby keeping a state where the opposite polarity toner is unlikely to adhere to the brush 55. Thus, a reduction in the ability of the electrically conductive brush 51 to remove paper dust and filming on the photosensitive drum 27 can be suppressed, which contributes to favorable image formation.

As the accumulated number of pages printed is used as the image formation amount, the cleaning bias applied to the electrically conductive brush 51 can be controlled in accordance with the time when an image is actually formed. Thus, the brush 51 can receive a proper cleaning bias to cope with a change of the charged status due to the deterioration of toner, that is, a reduction of the toner charge amount Q/M, thereby reliably preventing toner from adhering to the brush 55.

In the above examples, described with reference to FIGS. 3 and 4, the potential of the brush 55 is decreased in stages so as to decrease the potential difference between the photosensitive drum 27 and the brush 55 gradually. However, a method for decreasing the potential difference is not limited to the above examples. The potential of the brush 55 may be controlled so as to drop from 400V to 340V linearly with substantially the same slant as the drop in the toner charge amount Q/M as shown in FIG. 5.

Figure 5:
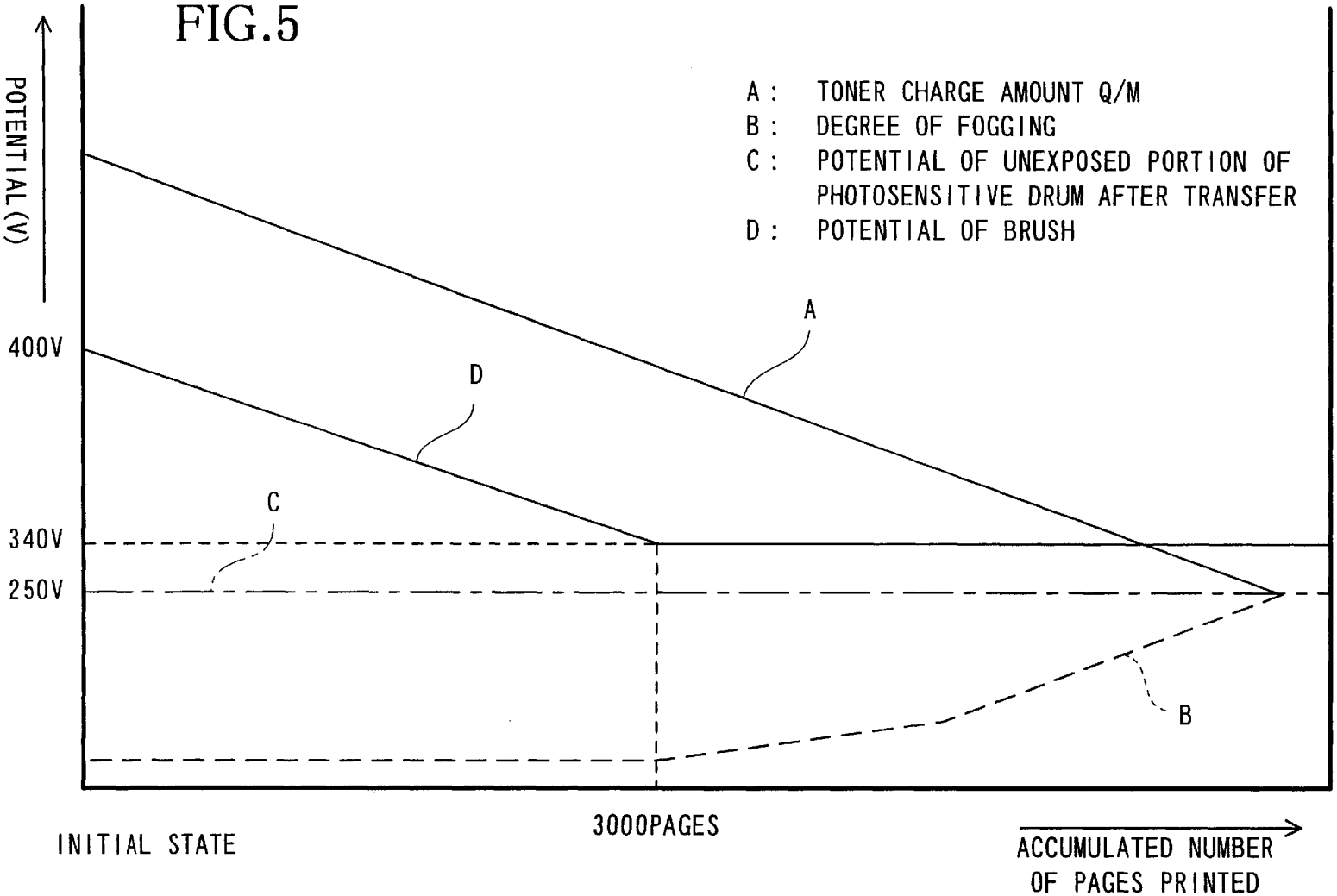
FIG. 5 is a graph illustrating the control of the cleaning bias of the laser printer shown in FIG. 1 using straight line reduction.
Figure 6:
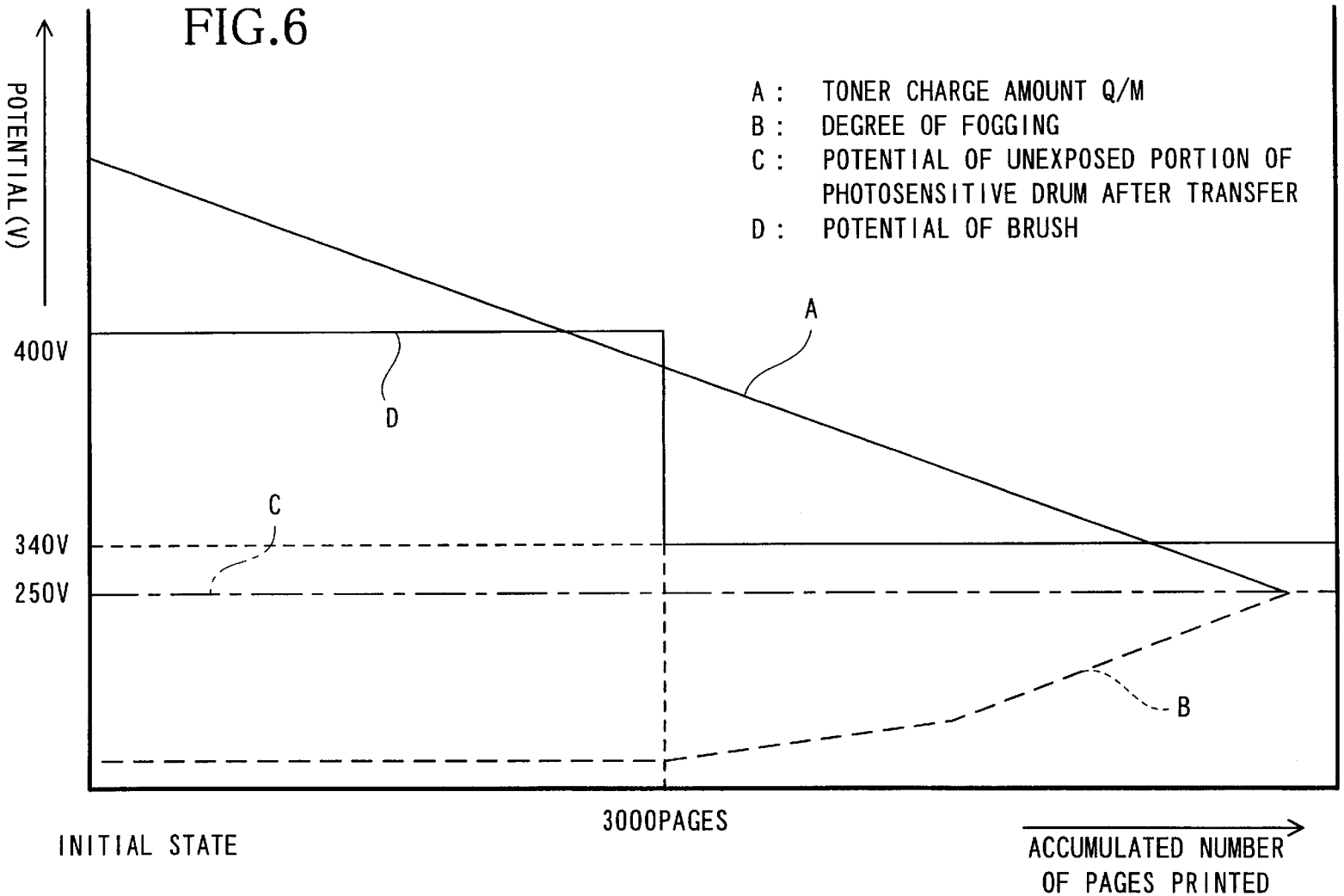
FIG. 6 is a graph illustrating the control of the cleaning bias of the laser printer shown in FIG. 1 by reducing it when fogging becomes obvious.

Although toner deteriorates linearly with the increase in the accumulated number of pages printed, fogging actually becomes evident when the accumulated number of pages printed exceeds approximately 3,000 as shown by a broken line B of FIG. 5. Therefore, to cope with fogging, rather than toner deterioration, the bias power supply 53 may be controlled such that, when fogging becomes evident, the potential of the brush 55 can be decreased from approximately 400V, which continues after the initial state, to approximately 340V, as shown by a solid line D in FIG. 6.

In the above description, the image formation amount is reset to the initial state when the developing cartridge 28 is replaced. However, the image formation amount should be reset to the default value in the case where the toner box 34*b* is filled with new toner, with the cartridge 28 remaining mounted in the laser printer 1. In such a case, an operation switch for resetting to the initial state may be provided such that, when the user touches the operation switch after refilling the toner box 34*b* with toner, the laser printer 1 can be reset to the initial state.

Even if new toner is supplied to the toner box 34*b*, the deteriorated toner remains in the developing chamber 34*a*. In other words, even when the initial state is established with the touch of the operation switch, the deteriorated toner remaining in the developing chamber 34*a* is supplied to the photosensitive drum 27 for some time, and fogging becomes evident. In addition, the opposite polarity toner contained in the deteriorated toner may adhere to the brush 55.

Figure 7:
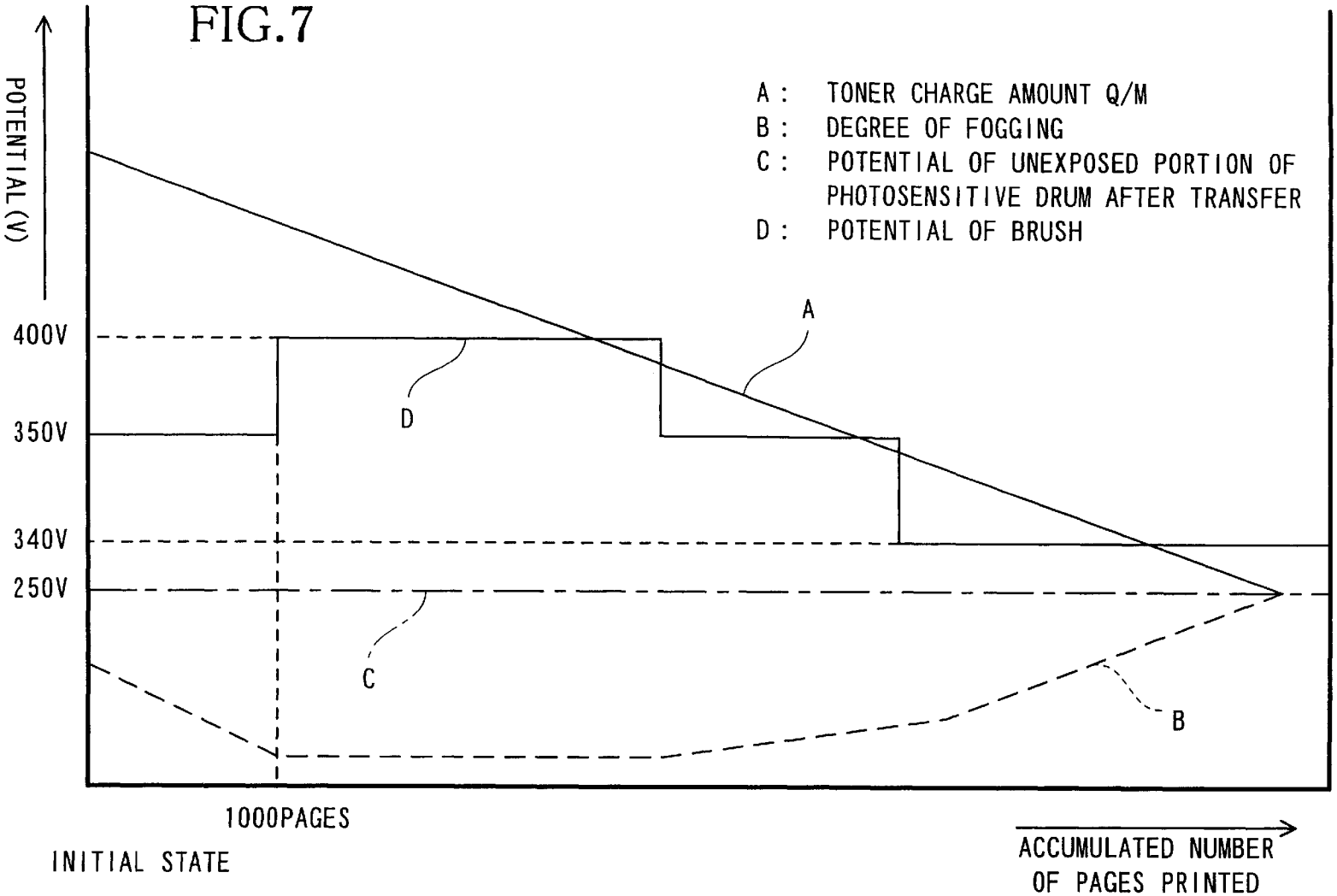
FIG. 7 is a graph illustrating the control of the cleaning bias of the laser printer shown in FIG. 1 by raising the cleaning bias from the initial state and then reducing the cleaning bias gradually.

Accordingly, as shown in FIG. 7, the potential of the brush 55 immediately after the initial state is set to 350V, which is lower than that described above. With this state, printing is performed and the potential of the brush 55 is raised to 400V when the accumulated number of pages printed reaches approximately 1,000, which is the timing when the deteriorated toner is used up and fogging becomes inconspicuous.

After that, as is the case with the above-described control, the potential of the brush 55 is controlled so as to decrease in stages with the increase in the accumulated number of the pages printed. Thus, toner can be prevented from adhering to the electrically conductive brush 51, and paper dust can be efficiently removed.

Usually, new toner is supplied when the toner empty is displayed. However, it may be supplied to the toner box 34*b* even when a sufficient amount of toner still remains therein. In this case, the bias power supply 53 may be controlled so as to keep the potential of the brush 55 appropriate according to the proportion of the remaining toner and new toner.

The bias power supply 53 may be controlled so as not only to decrease but also to increase the potential difference between the photosensitive drum 27 and the brush 55 gradually with the increase in the image formation amount.

Figure 8:
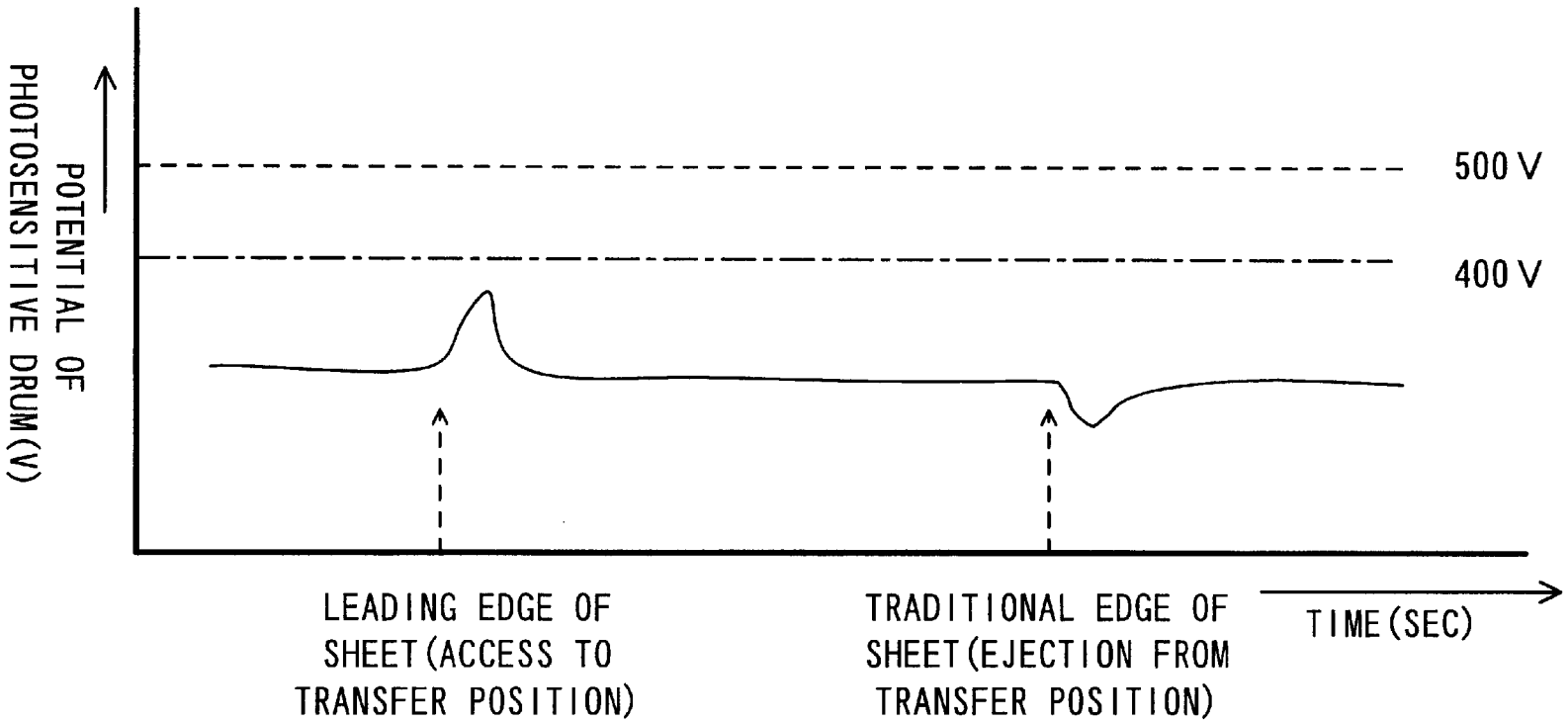
FIG. 8 shows a change in the surface potential of the photosensitive drum during transferring in the laser printer shown in FIG. 1.

As shown in FIG. 8, when the leading edge of the sheet 3 goes between the transfer roller 30 and the photosensitive drum 27, an electrical resistance therebetween varies steeply. On the other hand, as the transfer bias controlled at a fixed current is applied to the transfer roller 30, the resistance between the transfer roller 30 and the photosensitive drum 27 varies suddenly. As a consequence, the surface potential of the unexposed portion of the photosensitive drum 27 rises partially, and the potential of the brush 55 may become higher than 400V.

If the opposite polarity toner adheres to the brush 55, it is released to a portion of the photosensitive drum 27 where the potential is partially raised. The released toner is not collected by the developing roller 31, but transferred to the sheet 3 by contact with the sheet 3, and may appear in streaks on the printed side thereof.

The opposite polarity toner hardly adheres to the brush 55 until the accumulated number of pages printed reaches 4,000. Therefore, the CPU 56 controls the bias power supply 53 so as to maintain the potential of the brush 55 at approximately 400V until the accumulated number of pages printed reaches 4000, as shown in FIG. 9.

When the accumulated number of pages exceeds 4,000, deterioration of toner proceeds, and adhesion of the opposite polarity toner to the brush 55 increases. Thus, after the accumulated number of pages printed exceeds 4,000, the CPU 56 controls the bias power supply 53 so as to maintain the potential of the brush 55 at approximately 500V, which is higher than the surface potential of the photosensitive drum 27, which partially rises.

Figure 9:
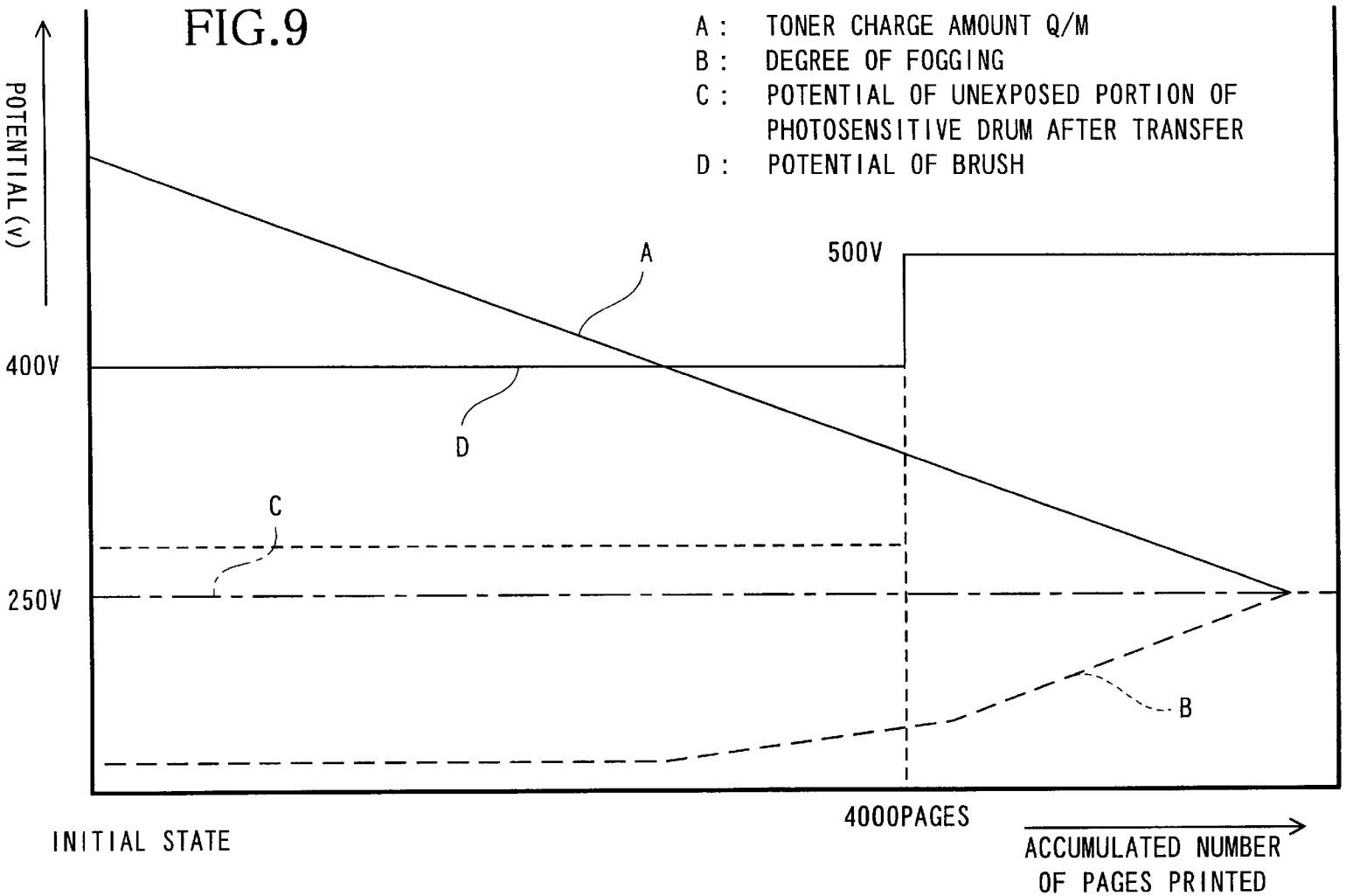
FIG. 9 is a graph illustrating the control of the cleaning bias of the laser printer shown in FIG. 1 by raising the cleaning bias when fog increases.

With the control as shown in FIG. 9, even if the opposite polarity toner increasingly adheres to the brush 55 in accordance with the increase in the accumulated number of the pages printed, it is not released to the surface of the photosensitive drum 27. Thus, the deterioration of the image quality can be prevented.

The advantages of the above-described brush 55 will now be described more specifically with reference to experimental examples where various types of brushes were used. The resistances of the brushes were measured with a method shown in FIG. 10 and the durability of each brush was evaluated.

The following four different types of brushes were used.

I. Brush A
- Filament property: acrylic fiber where carbon is dispersed at low density
- Filament size: 6 deniers (approximately 24 μm in diameter)
- Density: 100,000 filaments per square inch (15,500 filaments/$cm^2$ or 155 filaments/$mm^2$)
- Area covered with filaments: 226 mm×4 mm
- Cross sectional area of the filaments: 0.81 $cm^2$ II. Brush B
- Filament property: acrylic fiber where carbon is dispersed at low density
- Filament size: 6 deniers (approximately 24 μm in diameter)
- Density: 120,000 filaments per square inch (18,600 filaments/$cm^2$ or 186 filaments/$mm^2$)
- Area covered with filaments: 226 mm×5 mm
- Cross sectional area of the filaments: 1.17 $cm^2$ III. Brush C
- Filament property: a low resistance core where carbon is dispersed at a high density, coated with acrylic insulating material
- Filament size: 6 deniers (approximately 24 μm in diameter)
- Density: 100,000 filaments per square inch (15,500 filaments/$cm^2$ or a 155 filaments/$mm^2$)
- Area covered with filaments: 226 mm×4 mm
- Cross sectional area of the filaments: 0.81 $cm^2$ IV. Brush D
- Filament property: acrylic fiber where carbon is dispersed at high density
- Filament size: 6 deniers (approximately 24 μm in diameter)
- Density: 100,000 filaments per square inch (15,500 filaments/$cm^2$ or 155 filaments/$mm^2$)
- Area covered with filaments: 226 mm×4 mm
- Cross sectional area of the filaments: 0.81 $cm^2$ Notice that brushes A to D have a trim length of 6 mm.

As described above, the resistances of brushes A, B, C, and D were measured in both a low temperature, low humidity (L/L) environment and a high temperature, high humidity (H/H) environment, using the device illustrated in FIG. 10. Their volume resistances Rv were calculated using formula 1. Table 1 shows the volume resistances Rv. The L/L environment is defined by a temperature of 10° C. and a relative humidity of 20%, and the H/H environment is defined by a temperature of 32.5° C. and a relative humidity of 80%.

TABLE 1

| | Volume resistance Rv [unit: Ω-cm] | |
|---|---|---|
| | L/L | H/H |
| Brush A | $1 \times 10^9 - 8 \times 10^9$ | $1 \times 10^7 - 5 \times 10^7$ |
| Brush B | $3 \times 10^9 - 15 \times 10^9$ | $3 \times 10^7 - 10 \times 10^7$ |
| Brush C | $1 \times 10^8 - 8 \times 10^8$ | $2 \times 10^8 - 9 \times 10^8$ |
| Brush D | $2 \times 10^5 - 8 \times 10^5$ | $3 \times 10^5 - 10 \times 10^5$ |

As can be seen from Table 1, in the cases of brush A and brush B, the volume resistances in the H/H environment are lower by two digits than those in the L/L environment. This is because the filaments used in brush A and brush B are very fine (6 deniers) and likely to absorb moisture on the surfaces thereof. The moisture facilitates the current flow in the H/H environment where the relative humidity is high. A degree of the moisture absorption to the surface of the filament is dependent on a relative humidity, and not greatly dependent on the ambient temperature. That is, as long as the humidity is the same, the same resistance can be obtained even if the temperature is changed.

In the case of brush C, each filament is produced by coating a low resistance core, in which carbon is dispersed at a high density, with an acrylic insulating material. As the current flows mainly in the core, moisture on the surface of each filament has little effect on the resistance of brush C.

In the case of brush D, a high density of carbon is dispersed in the filaments and the resistance is low. The reduction of the resistance due to the adhesion of moisture to the filament surface is so small that it may be ignored. Thus, the resistance hardly varies according to a change in the environment.

To evaluate the durability of brushes A to D, an intermittent printing durability test was conducted in the L/L and the H/H environments. Table 2 shows evaluation results of print samples taken after 20,000 pages were printed in both the L/L and H/H environments.

The intermittent printing durability test is a cycle test in which printing is conducted intermittently. In the test, after the laser printer 1 is powered on, one page is printed, and then each unit of the laser printer 1 is suspended. In comparison with the continuous printing test, the intermittent printing test is conducted under harsh conditions because the operation time of the motor 5 is long.

TABLE 2

| | L/L | | H/H | |
|---|---|---|---|---|
| | Paper dust | Filming | Paper dust | Filming |
| Brush A | ○ | ○ | ○ | ○ |
| Brush B | ○ | ○ | ○ | ○ |
| Brush C | ○ | Δ | Δ | ○ |
| Brush D | ○ | X | ○ | ○ |

○: Good
Δ: Not Good
X: Bad

As shown in Table 2, brushes A did not cause filming on the photosensitive drum 27 in any environment, and paper dust was not adhered to the sheet 3.

Brush C caused filming slightly in the L/L environment and paper dust was adhered to the sheet 3 in the H/H environment.

For brush D, the occurrence of filming was considerably accelerated compared with other brushes A, B, C, and image quality printed on the sheet 3 worsened. In the L/L environment, filming was accelerated when toner is adhered to the brush 55. In addition, when the current flowing in the brush 55 becomes great, toner is increasingly adhered to the brush 55. In the case of brush D, the resistance was low and the current flowing through the brush 55 was large, and toner adhered greatly to the brush 55. As a result, filming was accelerated.

Brush C structurally has a portion where the current is concentrated. As toner was adhered to the portion, filming tended to occur compared with brushes A and B.

In the H/H environment, adhesion of paper dust to the photosensitive drum 27 becomes strong compared with that in the L/L environment. To remove paper dust from the surface of the photosensitive drum 27 with the brush 55, a large current should be fed through the brush 55. On the other hand, because the toner remaining on the surface of the photosensitive drum 27 after transferring is liable to lose charge, it hardly adheres to the brush 55 even if the current flowing in the brush 55 is increased.

For brush A, brush B, and brush D, the resistance dropped in the H/H environment, and the amount of current flowing through the brush 55 was sufficient to remove paper dust from the photosensitive drum 27.

For brush C, the resistance in the H/H environment was high when compared to brushes A, B, and D, and the current required to remove paper dust did not flow through the brush 55. Thus, brush C was slightly inferior to brushes A, B and D as to the ability to remove paper dust. Paper dust adhered on the photosensitive drum 27 was not removed and but returned to the sheet 3 by contact with the sheet 3.

A similar durability test was conducted by changing the density of brush A, which showed favorable feature in the above durability test. Table 3 shows test results regarding paper dust and filming.

TABLE 3

| | L/L | | H/H | |
|---|---|---|---|---|
| Density | Paper dust | Filming | Paper dust | Filming |
| (a) | ○ | ○ | ○ | ○ |
| (b) | ○ | ○ | ○ | ○ |
| (c) | ○ | ○ | ○ | ○ |
| (d) | X | ○ | X | ○ |

○: Good
Δ: Not Good
X: Bad
(a): 100,000 filaments/square inch (15,500 filaments/$cm^2$ or 155 filaments/$mm^2$)
(b): 75,000 filaments/square inch (11,625 filaments/$cm^2$ or 116.25 filaments/$mm^2$)
(c): 50,000 filaments/square inch (7750 filaments/$cm^2$ or 77.5 filaments/$mm^2$)
(d): 25,000 filaments/square inch (3875 filaments/$cm^2$ or 38.75 filaments/$mm^2$)

It is apparent from Table 3 that the brush 55 can have a sufficient ability to remove paper dust if the density is greater than 50,000 filaments/square inch. If the density is lower than this, the paper dust adhered to the photosensitive drum 27 may slip into the filaments of the brush 55, which impairs the ability to remove paper dust.

In the embodiment, the brush 55 of the electrically conductive brush 51 has a volume resistance of $10^9$ Ω-cm or more in the L/L environment and $10^8$ Ω-cm or less in the H/H environment.

Accordingly, in the L/L environment, as the current flowing in the brush 55 is small, the toner charged with the opposite polarity is prevented from adhering to the brush 55. In the H/H environment, as the current flowing in the brush 55 is large, the potential difference between the photosensitive drum 27 and the brush 55 can be provided such that the brush 55 can sufficiently catch the paper dust adhering to the surface of the photosensitive drum 27 strongly in comparison with the L/L environment. In this manner, paper dust can be sufficiently removed at the same time that filming on the photosensitive drum 27 can be suppressed.

If the filament size of the brush 55 is greater than 10 deniers, the brush 55 becomes firm, with the result that the brush 55 may slide on the photosensitive drum 27 with a strong force, causing filming on the photosensitive drum 27.

However, as the brush 55 of the embodiment is made of fine filaments of 10 deniers or less, the brush 55 is not too firm, and makes contact with the photosensitive drum 27 with an adequate force. Thus, filming on the photosensitive drum 27 is suppressed.

It can be the surface of each filament of the brush is coated with metal. However, as the resistance of the metal hardly changes with a humidity change, the current flowing through the brush is substantially constant in both the L/L environment and the H/H environment.

As the filaments of the brush 55 are made by dispersing electrically conductive particles or fillers into an insulating base material of nylon, acrylic, or rayon, the resistance can be kept high in the L/L environment. In addition, the resistance becomes low in the H/H environment because of the adhesion of moisture to the surface of each filament of the brush 55. As a result, in the L/L environment, the current flowing through the brush 55 becomes small, so that the opposite polarity toner can be prevented from adhering on the brush 55. In the H/H environment, the current flowing through the brush 55 becomes large, so that the potential difference between the photosensitive drum 27 and the brush 55 can be provided such that the brush 55 can sufficiently catch the paper dust adhering to the surface of the photosensitive drum 27 strongly in comparison with the L/L environment. Thus, filming on the photosensitive drum 27 can be reduced in any environment, and paper dust can be sufficiently removed.

In the laser printer 1, a developing bias may be changed according to the accumulated operation time of the developing roller 31. In this case, the cleaning bias can be controlled in accordance with the control of the developing bias.

As an alternate method to determine a timing to place the laser printer 1 in the initial state, the following can be considered:

A fuse may be provided in a new developing cartridge 28 filled with new toner and structured such that the fuse is blown when the laser printer 1 mounting the new developing cartridge 28 is started. When the blown fuse is detected, the laser printer 1 is placed in the initial state.

In the embodiment, the electrically conductive brush 51, having the brush 55, is used as a paper dust remover, however, any structure is acceptable as long as paper dust can be removed by making contact with the photosensitive drum 27. For example, an unwoven cloth, which can collect paper dust only without collecting the toner on the photosensitive drum 27, may be used.

While the invention has been described in detail and with reference to the specific embodiments thereof, it would be apparent to those skilled in the art that various changes, arrangements and modifications may be applied therein without departing from the spirit and scope of the invention.

What is claimed is:

1. An image forming apparatus, comprising:

an image holding member that holds an image formed by a developing agent thereon;

a transferring device that transfers the image on the image holding member to a paper;

a paper dust removing device that removes a paper dust from the image holding member;

a biasing device that applies a bias to the paper dust removing device to form a potential difference between the image holding member and the paper dust removing device; and a controller that determines a value corresponding to total amount of the formed image, the controller controlling the biasing device to vary the bias to the paper dust removing device in accordance with the determined value.

2. The image forming apparatus according to claim 1, wherein the biasing device applies the bias to the paper dust removing device to form the potential difference such that the paper dust moves to the paper dust removing device from the image holding member.

3. The image forming apparatus according to claim 1, further comprising:

a developing agent container that accommodates the developing agent therein; and a developing agent holding member that holds the developing agent thereon and supplies the developing agent to the image holding member, wherein the controller controls the biasing device to apply the bias to the paper dust removing device to form an initial potential difference between the image holding member and the paper dust removing device at an initial state when the developing container accommodates a new developing agent.

4. The image forming apparatus according to claim 3, wherein the controller controls the biasing device to apply the bias to the paper dust removing device to reduce the potential difference from the initial potential difference in accordance with the determined value.

5. The image forming apparatus according to claim 3, wherein the controller controls the biasing device to apply the bias to the paper dust removing device so as to avoid discharge from the paper dust removing device.

6. The image forming apparatus according to claim 4, wherein the controller controls the biasing device to apply the bias to the paper dust removing device to form a minimal potential difference to remove the paper dust from the image holding member.

7. The image forming apparatus according to claim 3, wherein the controller controls the biasing device to apply the bias to the paper dust removing device to reduce the potential difference from the initial potential difference in accordance with the determined value step by step.

8. The image forming apparatus according to claim 3, wherein at least the developing agent container is detachably attachable to the image forming apparatus, and wherein the controller controls the biasing device to apply the bias to the paper dust removing device to form the initial potential difference between the image holding member and the paper dust removing device when the developing agent container is attached.

9. The image forming apparatus according to claim 3, further comprising a sensor that outputs an empty signal of the developing agent in the developing agent container, wherein the controller controls the biasing device to apply the bias to the paper dust removing device to form the initial potential difference between the image holding member and the paper dust removing device when the empty signal is cancelled.

10. The image forming apparatus according to claim 1, wherein the controller determines the value corresponding to the total amount of the formed image based on total driven time of the developing agent holding element.

11. The image forming apparatus according to claim 1, wherein the controller determines the value corresponding to the total amount of the formed image based on total pages of the formed image.

12. The image forming apparatus according to claim 1, wherein the paper dust removing device includes a conductive element that contacts the image holding member.

13. The image forming apparatus according to claim 12, wherein the conductive element is made of a brush.

14. The image forming apparatus according to claim 13, wherein volume resistance of the brush at 20% relative humidity is not less that $10^9$ Ω-cm.

15. The image forming apparatus according to claim 14, wherein volume resistance of the brush at 80% relative humidity is less than $10^8$ Ω-cm.

16. The image forming apparatus according to claim 13, wherein a fiber of the brush is not more than 10 denier.

17. The image forming apparatus according to claim 13, wherein the brush is made of nylon fiber, acrylic fiber or rayon fiber to which electroconductive particles or electroconductive filler is dispersed.

18. The image forming apparatus according to claim 13, wherein a fiber density of the brush is more than 50,000 filaments/square inch.

19. The image forming apparatus according to claim 12, wherein the conductive element is made of a non-woven cloth.

20. A paper dust removing device mounted in a drum cartridge also mounting a rotatable photosensitive drum, the drum cartridge removably received in a printing apparatus having a controller, a developing cartridge, a toner sensor that senses toner available, and a drive mechanism for the photosensitive drum and toner feed components, the paper dust removing device comprising:

a frame;

a conductive base member;

a bias voltage source electrically connected to the conductive base member; and a brush made up of a plurality of electrically chargeable filaments mounted in the frame and having free ends of the plurality of filaments in contact with the photosensitive drum, wherein an electrical bias applied to the brush is varied by the controller based on a total amount of formed images.

21. The paper dust removing device according to claim 20, wherein the controller controls the bias voltage source to apply the bias to the paper dust removing device so as to avoid discharge from the paper dust removing device.

22. The paper dust removing device according to claim 20, wherein the controller controls the biasing voltage source to apply the bias to the paper dust removing device to form a minimal potential difference to remove the paper dust from the image holding member.

23. The paper dust removing device according to claim 20, wherein volume resistance of the brush at 20% relative humidity is not less that $10^9$ Ω-cm.

24. The paper dust removing device according to claim 23, wherein volume resistance of the brush at 80% relative humidity is less than $10^8$ Ω-cm.

25. The paper dust removing device according to claim 20, wherein each filament of the brush is not more than 10 denier.

26. The paper dust removing device according to claim 20, wherein the plurality of filaments are made of nylon fiber, acrylic fiber or rayon fiber to which electroconductive particles or electroconductive filler is dispersed.

27. The paper dust removing device according to claim 26, wherein a filament density of the brush is more than 50,000 filaments/inch$^2$.

* * * * *